US011509996B2

(12) United States Patent
Kim et al.

(10) Patent No.: US 11,509,996 B2
(45) Date of Patent: Nov. 22, 2022

(54) DEVICES FOR PLAYING ACOUSTIC SOUND AND TOUCH SENSATION

(71) Applicant: Electronics and Telecommunications Research Institute, Daejeon (KR)

(72) Inventors: Hye Jin Kim, Daejeon (KR); JoonMin Lee, Daejeon (KR); Yun-Jeong Kim, Daejeon (KR); YuLim Min, Daejeon (KR); Wooseup Youm, Daejeon (KR); Hanbit Jin, Daejeon (KR); Chan-Hwa Hong, Sejong-si (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 17/328,528

(22) Filed: May 24, 2021

(65) Prior Publication Data

US 2022/0014841 A1 Jan. 13, 2022

(30) Foreign Application Priority Data

Jul. 10, 2020 (KR) ..... 10-2020-0085513

(51) Int. Cl.
*H04R 1/28* (2006.01)
*H04R 1/02* (2006.01)
*H04R 5/02* (2006.01)

(52) U.S. Cl.
CPC ..... *H04R 1/2811* (2013.01); *H04R 1/028* (2013.01); *H04R 5/02* (2013.01)

(58) Field of Classification Search
CPC ..... H04R 1/2811; H04R 1/028; H04R 5/02
See application file for complete search history.

(56) References Cited

U.S. PATENT DOCUMENTS 9,715,276 B2 7/2017 Da Costa et al.
2011/0091051 A1* 4/2011 Thomason ..... G06F 1/1616 381/103
2014/0015777 A1 1/2014 Park et al.
(Continued)

FOREIGN PATENT DOCUMENTS

KR 1020130112799 A 10/2013
KR 1020140008229 A 1/2014
(Continued)

OTHER PUBLICATIONS

Nuria Torras et al., Liquid-crystalline elastomer micropillar array for haptic actuation, Journal of Materials Chemistry C, Materials for optical and electronic devices, The Royal Society of Chemistry, vol. 1, No. 34, Sep. 14, 2013, pp. 5183-5190.
(Continued)

*Primary Examiner* — Andrew L Sniezek
(74) *Attorney, Agent, or Firm* — William Park & Associates Ltd.

(57) ABSTRACT

The present disclosure relates to a device for playing an acoustic sound and a touch sensation, and more particularly, to a device for emitting a sound to a front surface of a speaker and playing a touch sensation feedback to a rear surface of the speaker through a driving modulation using two or more speakers while simultaneously concentrating an acoustic pressure generated according to a vibration of a membrane of the speaker to a surface of a module through a movement pipe when an audio signal is applied.

14 Claims, 11 Drawing Sheets

(56) References Cited

U.S. PATENT DOCUMENTS

| | | | | |
|---|---|---|---|---|
| 2014/0167940 | A1 | 6/2014 | Choi et al. | |
| 2014/0292501 | A1 | 10/2014 | Lim et al. | |
| 2016/0234588 | A1* | 8/2016 | Timothy | H04R 1/26 |
| 2019/0268693 | A1* | 8/2019 | Verbeke | G06F 3/0414 |
| 2020/0209969 | A1 | 7/2020 | Tretbar et al. | |

FOREIGN PATENT DOCUMENTS

| | | | |
|---|---|---|---|
| KR | 1020140079582 | A | 6/2014 |
| KR | 1020200023649 | A | 3/2020 |

OTHER PUBLICATIONS

R. Rashedin et al., Electromagnetic micro-actuator array for loudspeaker application, Sensors and Actuators A 129, 2006, Elsevier B.V., pp. 118-120.

* cited by examiner

DEVICES FOR PLAYING ACOUSTIC SOUND AND TOUCH SENSATION

CROSS-REFERENCE TO RELATED APPLICATIONS

This U.S. non-provisional patent application claims priority under 35 U.S.C. § 119 of Korean Patent Application No. 10-2020-0085513, filed on Jul. 10, 2020, the entire contents of which are hereby incorporated by reference.

BACKGROUND

The present disclosure herein relates to a device for playing an acoustic sound and a touch sensation, and more particularly, to a device for simultaneously playing an acoustic sound and a touch sensation feedback when an audio signal is applied.

A terminal that is manufactured in various shapes such as a mobile phone, a navigation unit, a digital information display (DID), and a tablet computer basically provides a touch interface. As a method for strengthening a user experience in conjunction with the touch interface, a haptic technology that transmits various multimedia contents and virtual augmented reality as a substantial sensation is being developed. Particularly, the haptic technology is widely used in various fields from a large-sized device used in a theater and a home theater to a portable small-sized device such as a notebook computer, a smart phone, a tablet computer, and a game console.

When a user interacts with a digital object, as various types of touch sensations are simultaneously provided, and a feedback in which a visual sensation, a hearing sensation, and a touch sensation are combined is provided to the user, further realistic user interface may be provided.

SUMMARY

The present disclosure provides a device for playing an acoustic sound and a touch sensation.

The object of the present invention is not limited to the aforesaid, but other objects not described herein will be clearly understood by those skilled in the art from descriptions below.

An embodiment of the inventive concept provides a device for playing an acoustic sound and a touch sensation, the device including: a lower frame; an upper frame disposed on the lower frame; two speakers spaced apart from each other in the upper frame; two speaker holes each disposed at an uppermost portion of the upper frame to emit a sound to the outside; a plurality of movement passages each extending from a lower portion of each of the speakers along the inside of the lower frame between the speakers; a pressure collecting part disposed between the speakers; and an actuator connected to the pressure collecting part, and an acoustic wave emitted to a lower portion of each of the speakers is transmitted to the pressure collecting part through the movement passages.

In an embodiment, the speakers may generate a sound, and the actuator may generate a touch sensation to a user through a vibration transmitted from the pressure collecting part.

In an embodiment, the device may further include two chambers that are empty spaces in the upper frame, and the speakers may be disposed in the chambers, respectively.

In an embodiment, wherein the speaker may include a vibration plate and a membrane, the membrane may emit an acoustic wave in upward and downward directions, and the vibration plate may vibrate air in the chamber by the acoustic wave emitted in the upward direction.

In an embodiment, each of the speakers may independently generate an acoustic wave having a different frequency or a different amplitude.

In an embodiment, the speaker holes may amplify an acoustic wave emitted to an upper portion of the speaker and generate a sound to the outside.

In an embodiment, the device may further include a fixing part configured to fix the actuator, and the fixing part may include a flexible material.

In an embodiment, the device may further include one pressure collecting part and one actuator, and each of the pressure collecting parts and actuators may be connected to each of the movement passages.

In an embodiment, the movement passages may include a gas, a liquid, or a gel therein.

In an embodiment of the inventive concept, a device for playing an acoustic sound and a touch sensation includes a plurality of unit cells. Here, each of the unit cells includes: two speakers; two speaker holes disposed on the speakers, respectively, to emit a sound to the outside; and an actuator disposed between the two speakers to generate a touch sensation vibration. Also, the speakers generate a sound to the outside by emitting an acoustic wave to a front surface of each of the speakers, and an acoustic wave emitted to a rear surface of each of the speakers is transmitted to the actuator, thereby generating a touch sensation to a user.

In an embodiment, the device may further include one speaker, one speaker hole, and a fixing part configured to fix the actuator, and the actuator and the fixing part may be disposed at a center of three speakers.

In an embodiment, the device may further include two speakers, two speaker holes, and a fixing part configured to fix the actuator, and the actuator and the fixing part may be disposed at a center of four speakers.

In an embodiment, the device may further include a plurality of movement passages each extending from the rear surface of each of the speakers to a rear surface of the actuator, and the movement passages may include a gas, a liquid, or a gel therein.

In an embodiment, the device may further include a pressure collecting part disposed between the movement passages and the rear surface of the actuator, and the pressure collecting part may concentrate an acoustic wave transmitted from the movement passages and transmit the concentrated acoustic wave to the actuator.

In an embodiment, the device may further include a fixing part disposed between the two speakers to fix the actuator.

In an embodiment, the unit cells may include polygonal shapes including a triangular shape to an octagonal shape, and the unit cells may be disposed adjacent to each other.

BRIEF DESCRIPTION OF THE FIGURES

The accompanying drawings are included to provide a further understanding of the inventive concept, and are incorporated in and constitute a part of this specification. The drawings illustrate embodiments of the inventive concept and, together with the description, serve to explain principles of the inventive concept. In the drawings.

DETAILED DESCRIPTION

Figure 1:
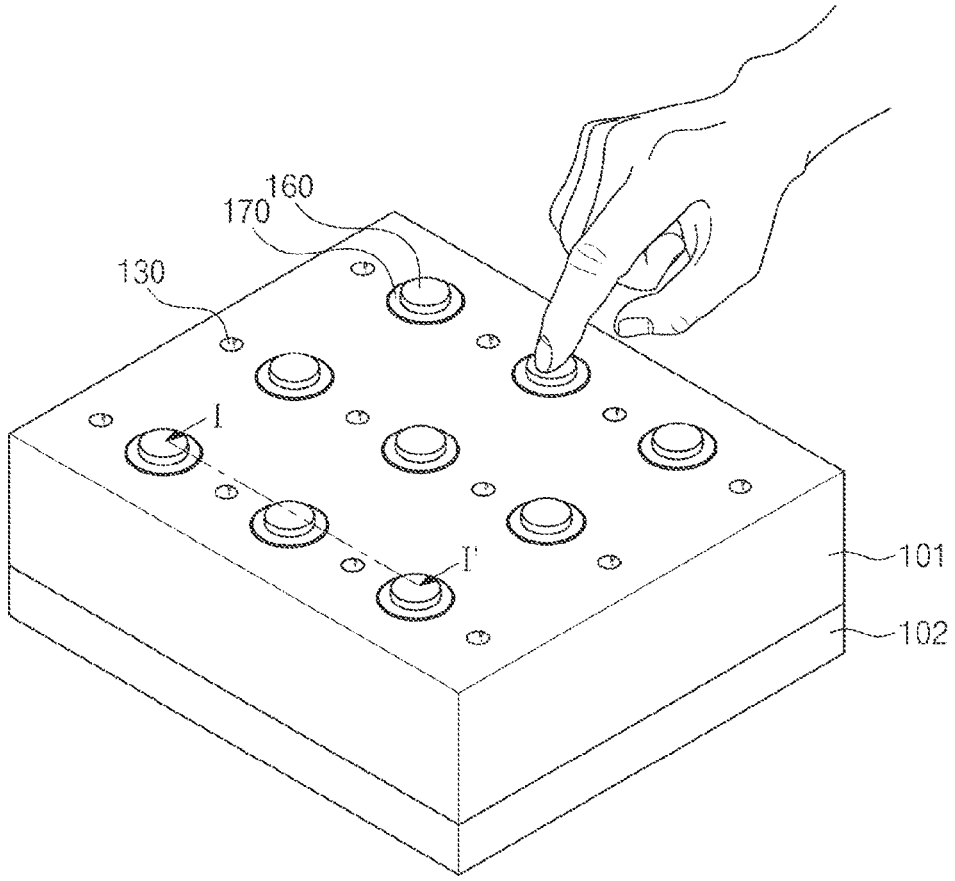
FIG. 1 is a schematic view of a device for playing an acoustic sound and a touch sensation according to an embodiment of the inventive concept.

Advantages and features of the present invention, and implementation methods thereof will be clarified through following embodiments described with reference to the accompanying drawings. The present invention may, however, be embodied in many different forms and should not be construed as being limited to the embodiments set forth herein. Rather, these embodiments are provided so that this disclosure will be thorough and complete, and will fully convey the concept of the invention to those skilled in the art. Further, the present invention is only defined by scopes of claims. Like reference numerals refer to like elements throughout.

In the following description, the technical terms are used only for explaining a specific exemplary embodiment while not limiting the present disclosure. The terms of a singular form may include plural forms unless referred to the contrary. The meaning of "include," "comprise," "including," or "comprising," specifies a property, a region, a fixed number, a step, a process, an element and/or a component but does not exclude other properties, regions, fixed numbers, steps, processes, elements and/or components.

Additionally, the embodiment in the detailed description will be described with sectional views as ideal exemplary views of the present invention. Also, in the figures, the dimensions of layers and regions are exaggerated for clarity of illustration. Accordingly, shapes of the exemplary views may be modified according to manufacturing techniques and/or allowable errors. Therefore, the embodiments of the present invention are not limited to the specific shape illustrated in the exemplary views, but may include other shapes that may be created according to manufacturing processes. Areas exemplified in the drawings have general properties, and are used to illustrate a specific shape of a semiconductor package region. Thus, this should not be construed as limited to the scope of the present invention.

Unless terms used in embodiments of the present invention are differently defined, the terms may be construed as meanings that are commonly known to a person skilled in the art.

FIG. 1 is a schematic view of a device for playing an acoustic sound and a touch sensation according to an embodiment of the inventive concept.

Figure 2:
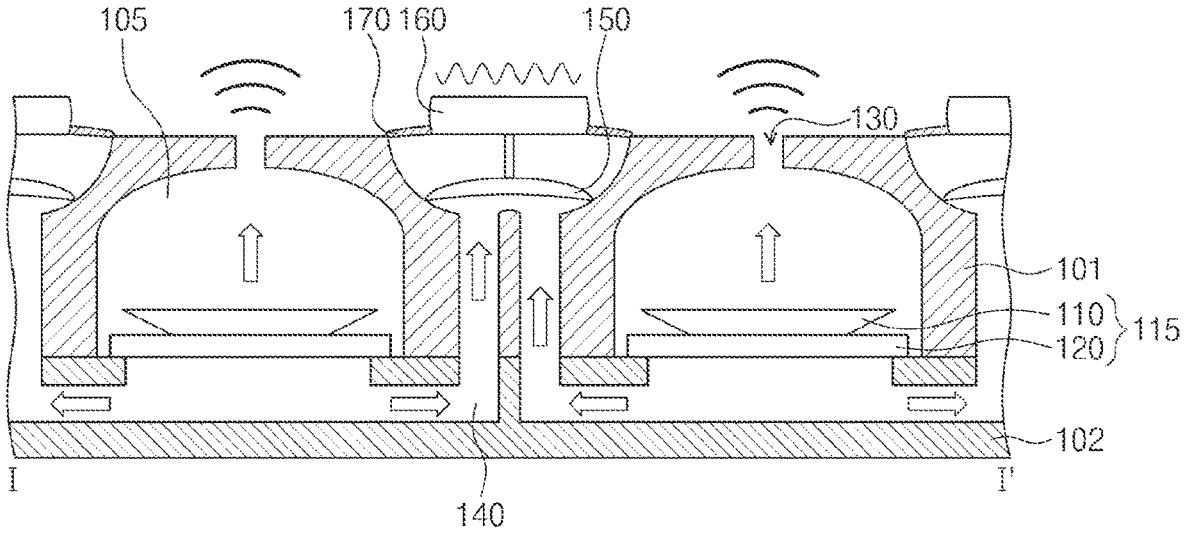
FIG. 2 is a cross-sectional view taken along line I-I' of FIG. 1.

FIG. 2 is a cross-sectional view taken along line I-I' in FIG. 1.

Referring to FIGS. 1 and 2, a device for playing an acoustic sound and a touch sensation may include an upper frame 101, a lower frame 102, a speaker 115, a speaker hole 130, a movement passage 140, a pressure collecting part 150, an actuator 160, and a fixing part 170.

The upper frame 101 may be disposed on the lower frame 102. The upper frame 101 and the lower frame 102 may be bonded to each other. The upper frame 101 may include a plurality of chambers 105 that are empty spaces therein. Each of the upper frame 101 and the lower frame 102 may include one of plastic, silicon-based elastomer, and insulated metal. A plurality of speaker holes 130, a plurality of actuators 160, and a plurality of fixing parts 170 may be disposed on the upper frame 101. Each of the actuators 160 and each of the speaker holes 130 may be arranged alternately with each other. Various touch sensation responses may be transmitted as vibrations having various frequencies to a hand positioned on the actuator 160.

The speaker 115 may be disposed in the chamber 105. The speaker 115 may include a vibration plate 110 and a membrane 120. The membrane 120 may be disposed on the lower frame 102, and the vibration plate 110 may be disposed on the membrane 120. That is, the speakers 115 may be disposed in the chambers 105, respectively.

All kinds of speakers capable of producing a sound may be used as the speaker 115. For example, the speaker 115 may include one of a magnetic coil speaker, a piezoelectric speaker, and a film speaker. The upper frame 101 may have a shape that does not shield a sound emitted to a lower portion of the speaker 115.

The vibration plate 110 may vibrate air in the chamber 105 by using an acoustic wave emitted from an upper portion of the membrane 120. A structure of the vibration plate 110 may have a cone shape.

The membrane 120 may emit an acoustic wave in upward and downward directions. The membrane 120 may provide a longitudinal wave from an electrical signal. The membrane 120 may include a material capable of providing a longitudinal wave. For example, the membrane 120 may include paper or plastic. The acoustic wave emitted from the upper portion of the membrane 120 may vibrate the air in the chamber 105 through the vibration plate 110, and a sound may be transmitted to the outside through the speaker hole 130. The acoustic wave emitted from a lower portion of the membrane 120 may be transmitted to the pressure collecting part 150 through the movement passage 140. The acoustic wave emitted to the lower portion of the membrane 120 may have a phase opposite to the acoustic wave emitted to the upper portion of the membrane 120.

A plurality of speaker holes 130 may be arranged in an uppermost portion of the upper frame 101. The speaker hole 130 may amplify a sound emitted from the upper portion of the membrane 120 and transmit the amplified sound to the outside. An uppermost portions of each of the chambers 105 may be connected to the outside through each of the speaker holes 130. That is, the upper frame 101 and the lower frame 102 may be almost completely sealed from the outside except for the speaker holes 130. The speaker hole 130 may have a hemisphere shape or a box shape for resonance of a sound.

The movement passage 140 may be disposed in the upper frame 101 and the lower frame 102. The movement passage 140 may extend from the lower portion of each of the membrane 120 along the inside of the lower frame 102 between the speakers 115 and be connected to the pressure collecting part 150. The movement passage 140 may transmit the acoustic wave emitted from the lower portion of the membrane 120 to the pressure collecting part 150. A medium capable of transmitting the acoustic wave emitted from the lower portion of the membrane 120 may be contained in the movement passage 140. For example, the medium in the movement passage 140 may include a gas (e.g., air), a liquid, or a gel. A characteristic of an acoustic pressure emitted to the outside may be variously changed according to the kind of the medium in the movement passage 140.

The pressure collecting part 150 may be disposed on the movement passage 140 and disposed between the speakers 115. The pressure collecting part 150 may concentrate the acoustic pressure transmitted to the movement passage 140 and transmit the concentrated acoustic pressure to the actuator 160.

The actuator 160 may be disposed between the speaker holes 130 and disposed on the pressure collecting part 150. The actuator 160 may receive a vibration generated by an acoustic pressure collected in the pressure collecting part 150 through direct contact with the pressure collecting part 150 or a connecting part directly contacting the pressure collecting part 150 and realize the received vibration as a touch sensation feedback. That is, a touch sensation vibration may be generated to a user. Also, the actuator 160 may generate a micro-vibration on the upper frame 101 through directly applying a signal. As the acoustic wave of each of the speakers 115 is independently adjusted, the touch sensation vibration realized in the actuator 160 may be variously adjusted.

The plurality of fixing parts 170 may be disposed on the pressure collecting part 150 and disposed between the speaker holes 130. The fixing parts 170 may fix the actuators 160, respectively. The fixing part 170 may have a doughnut structure or a circular structure and include a thin-film shape, a wrinkle shape, or a mesh shape. Thus, the fixing part 170 may have a shape that is restored although an external pressure (e.g., a pressure caused by a finger) is applied and maximizes the vibration so that the acoustic pressure is smoothly transmitted to the outside. The fixing part 170 may include a flexible material. For example, the fixing part 170 may include one of silicon, rubber, and plastic.

Figure 3:
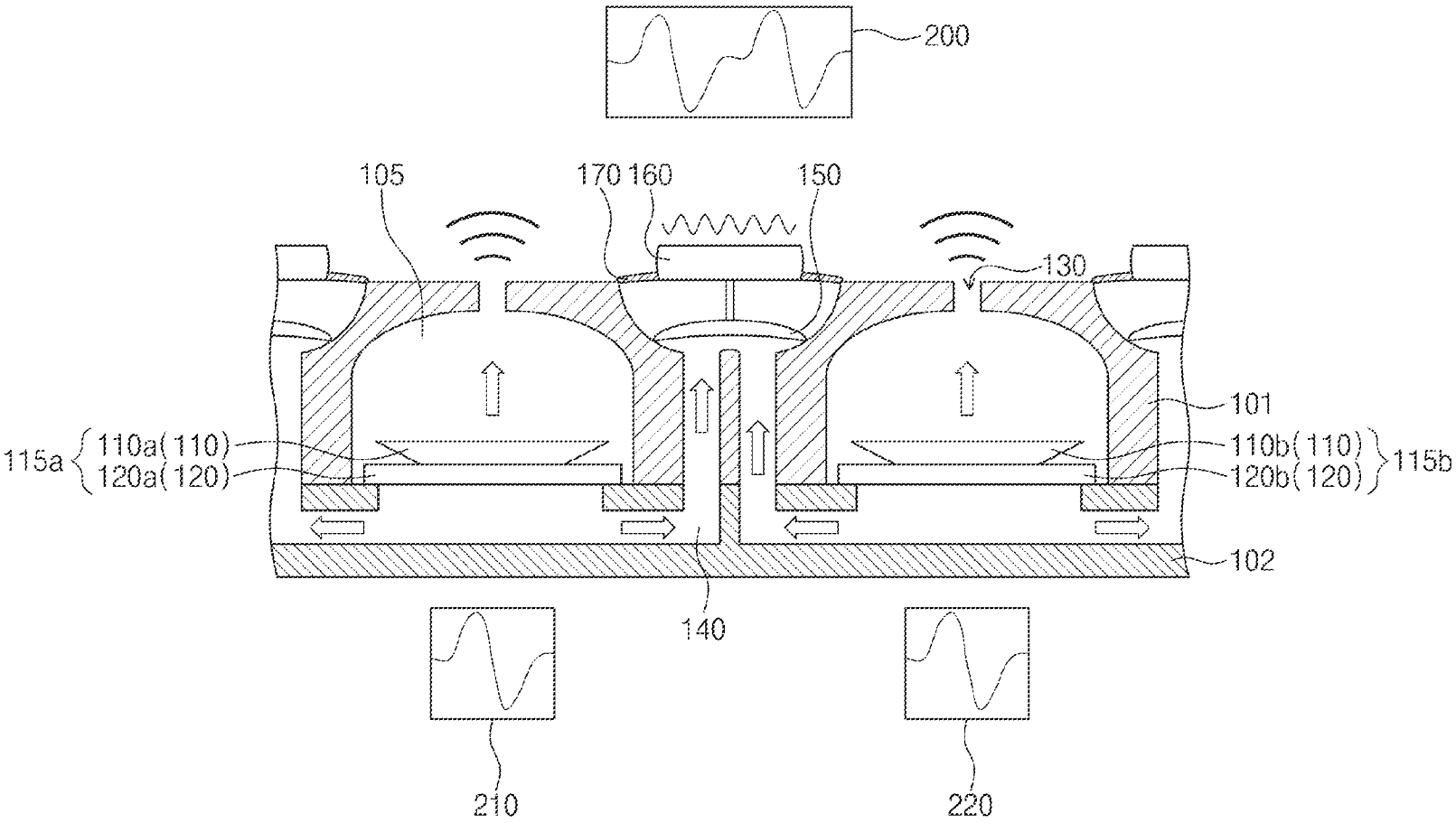
FIG. 3 is a schematic view illustrating a method for driving a touch sensation feedback according to an embodiment of the inventive concept.

FIG. 3 is a schematic view illustrating a method for driving a touch sensation feedback according to an embodiment.

Referring to FIG. 3, a speaker 115*a* may generate a first acoustic wave 210, and a speaker 115*b* may generate a second acoustic wave 220. The speaker 115*a* and the speaker 115*b* may alternately generate the first acoustic wave 210 and the second acoustic wave 220. The first acoustic wave 210 and the second acoustic wave 220 may have different frequencies and different amplitudes. Each of the first acoustic wave 210 and the second acoustic wave 220 emitted from the lower portions of the membranes 120, respectively, may be transmitted to the pressure collecting part 150 along the movement passage 140. The first acoustic wave 210 and the second acoustic wave 220 may overlap each other through the pressure collecting part 150 to generate an acoustic pressure 200. The acoustic pressure 200 may have a different frequency and a different amplitude from those of the first acoustic wave 210 and the second acoustic wave 220.

As the speakers 115*a* and 115*b* are independently operated, further fine and sophisticate touch sensation feedback may be realized, and a touch sensation vibration may be variously adjusted. Various touch sensation responses may be realized by a combination of a sound emitted from the speaker to the outside and a vibration of the actuator. Also, since an additional signal separation device is not required, an acoustic sound and a touch sensation response may be played through a simple driving circuit to reduce power consumption.

Figure 4:
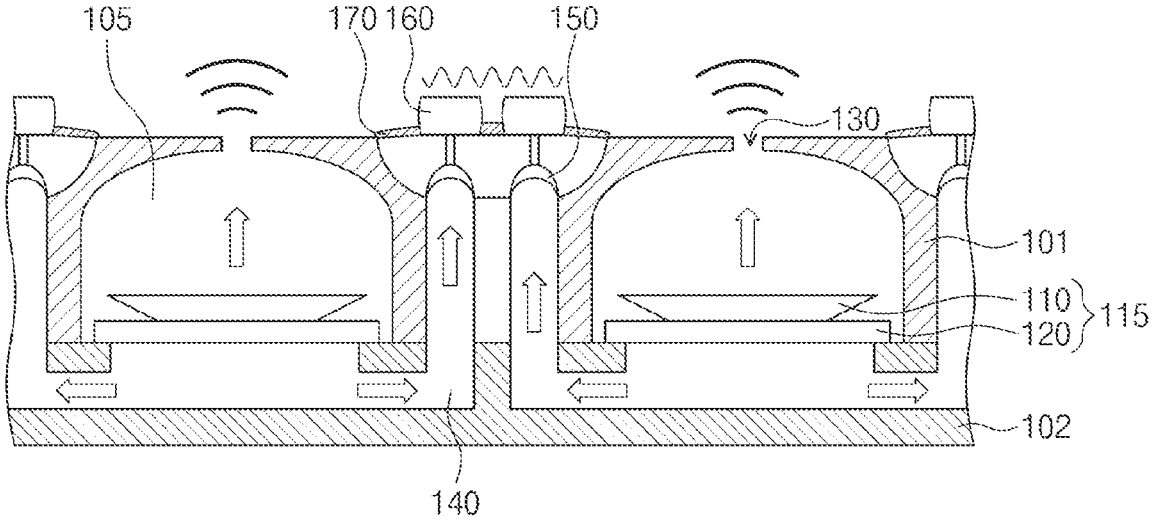
FIG. 4 is a cross-sectional view of a device for playing an acoustic sound and a touch sensation according to another embodiment of the inventive concept.

FIG. 4 is a cross-sectional view of a device for playing an acoustic sound and a touch sensation according to another embodiment of the inventive concept.

Referring to FIG. 4, two pressure collecting parts 150 may be disposed on the movement passage 140 and disposed between the speakers 115. The pressure collecting parts 150 may be connected to the movement passages 140, respectively. The pressure collecting parts 150 may be connected to actuators 160, respectively. The fixing part 170 may fix the actuators 160. As the two pressure collecting parts 150 and the two actuators 160 are disposed between the speakers 115, further fine and sophisticate touch sensation feedback may be generated.

Except that the two pressure collecting parts 150 and the two actuators 160 are disposed between the speakers 115, features of the another embodiment are substantially the same as features described with reference to FIGS. 1 to 3.

FIGS. 5A, 5B, 6, 7A, 7B, and 7C are plan views of a unit cell of a module for playing an acoustic sound and a touch sensation according to an embodiment of the inventive concept. The unit cell in the embodiment of the inventive concept may be defined as an arbitrary area on a plan view, which includes an actuator and a speaker minimally required to realize the device for playing an acoustic sound and a touch sensation.

Figure 5A:
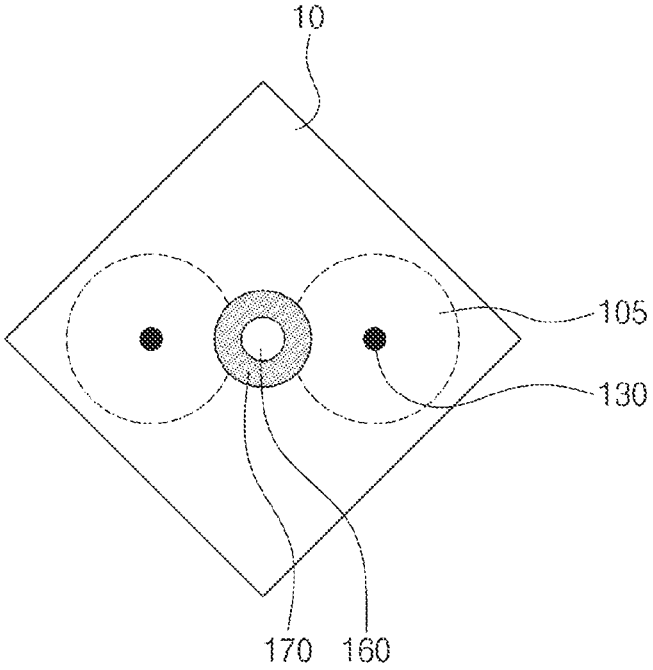
FIGS. 5A, 5B, 6, 7A, 7B, and 7C are plan views of a unit cell of a module for playing an acoustic sound and a touch sensation according to an embodiment of the inventive concept.
Figure 5B:
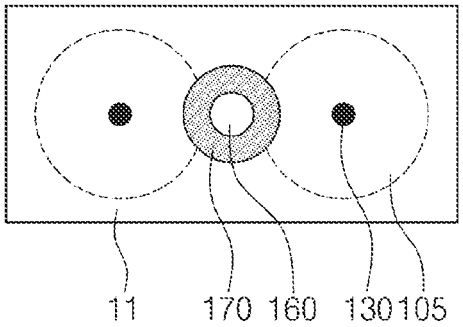

FIGS. 5A and 5B are plan views of a unit cell of a module for playing an acoustic sound and a touch sensation, which includes one actuator 160 and two speakers 115. Referring to FIG. 5A, one actuator 160 and two speakers 115 may be disposed in a diamond-shaped cell 10. Two chambers 105 may be disposed in the diamond-shaped cell 10. On a plane, speaker holes 130 may be defined at centers of the chambers 105, respectively. One actuator 160 and one fixing part 170 may be disposed between the two speaker holes 130. On the plane, a portion of the one fixing part 170 may overlap or contact the two chambers 105.

Referring to FIG. 5B, one actuator 160 and two speakers 115 may be disposed in a rectangular cell 11. The cell 11 is substantially the same as features described with reference to FIG. 5A except that the cell 11 has a rectangular shape.

Figure 6:
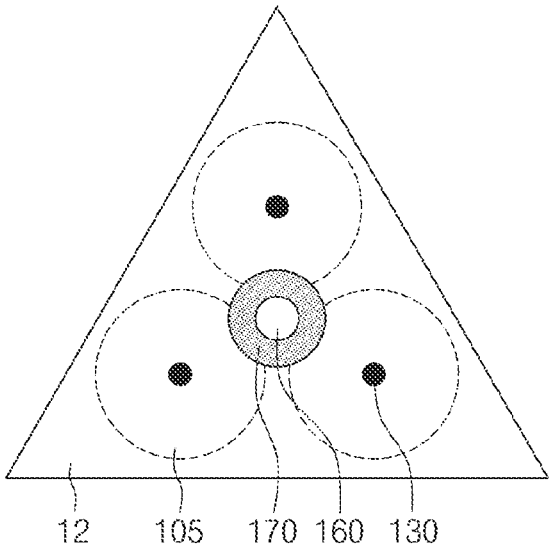

FIG. 6 is a plan view of a unit cell of a module for playing an acoustic sound and a touch sensation, which includes one actuator 160 and three speakers 115. Referring to FIG. 6, one actuator 160 and three speakers 115 may be disposed in a triangular cell 12. Three chambers 105 may be disposed in the triangular cell 12. On the plane, speaker holes 130 may be defined at centers of the chambers 105, respectively. One actuator 160 and one fixing part 170 may be disposed at a center of the three speaker holes 130. On the plane, a portion of the one fixing part 170 may overlap or contact the three chambers 105.

Figure 7A:
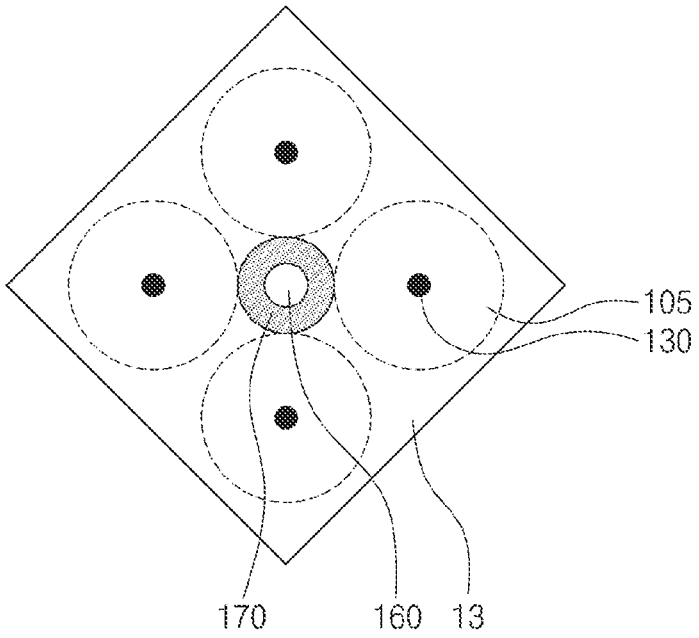
Figure 7B:
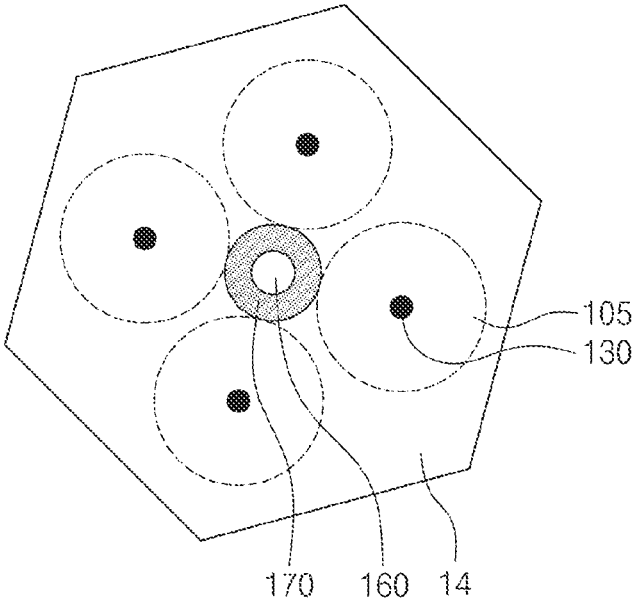
Figure 7C:
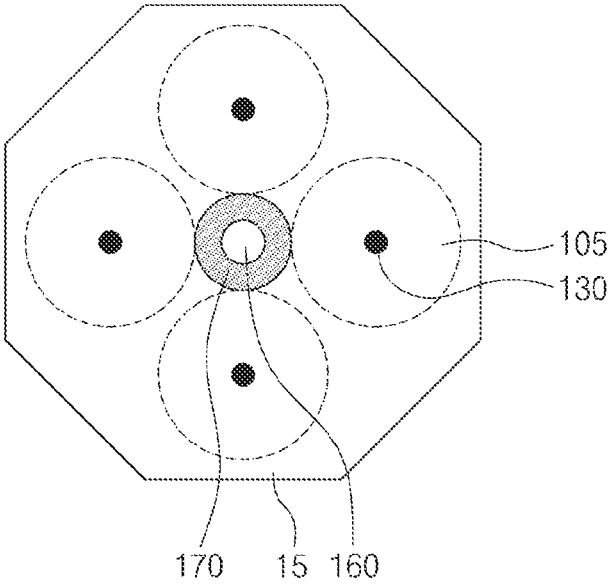

FIGS. 7A, 7B, and 7C are plan views of a unit cell of a module for playing an acoustic sound and a touch sensation, which includes one actuator 160 and four speakers 115. Referring to FIG. 7A, one actuator 160 and four speakers 115 may be disposed in a diamond-shaped cell 13. Four chambers 105 may be disposed in the diamond-shaped cell 13. On the plane, speaker holes 130 may be defined at centers of the chambers 105, respectively. One actuator 160 and one fixing part 170 may be disposed at a center of the four speaker holes 130. On the plane, a portion of the one fixing part 170 may overlap or contact the four chambers 105.

Referring to FIG. 7B, one actuator 160 and four speakers 115 may be disposed in a hexagonal cell 14. The cell 14 is substantially the same as features described with reference to FIG. 7A except that the cell 14 has a hexagonal shape.

Referring to FIG. 7C, one actuator 160 and four speakers 115 may be disposed in an octagonal cell 15. The cell 15 is substantially the same as the features described with reference to FIG. 7A except that the cell 15 has an octagonal shape.

FIGS. 8A, 8B, 8C, and 8D are plan views of an array of modules for playing an acoustic sound and a touch sensation according to an embodiment of the inventive concept.

Figure 8A:
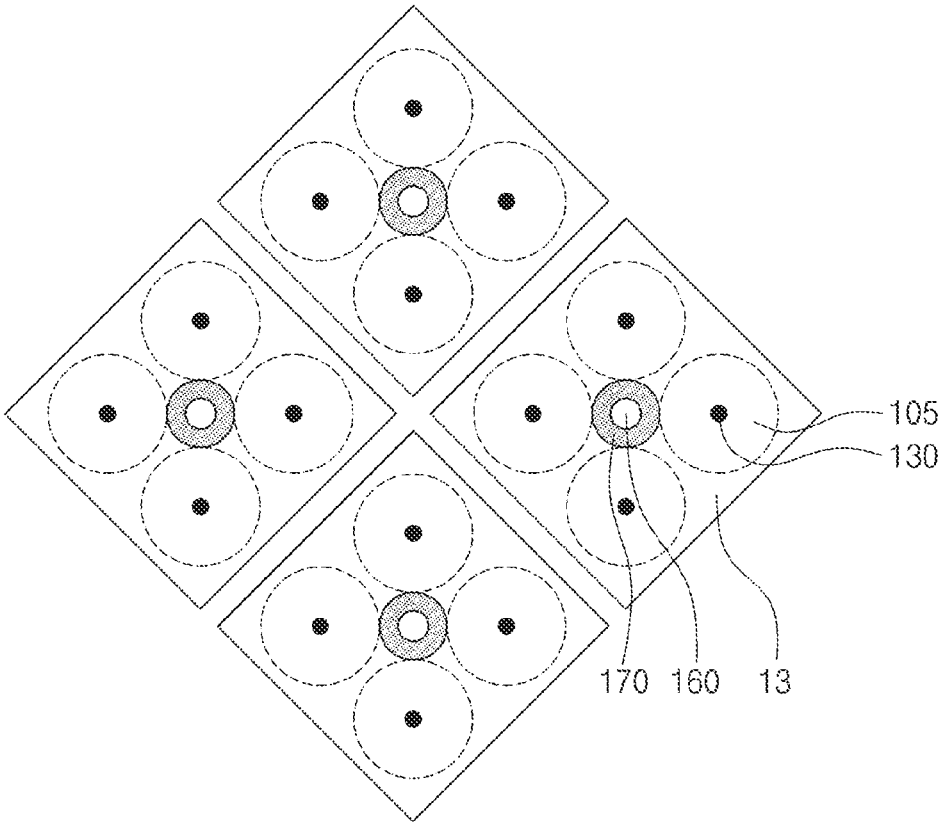
FIGS. 8A, 8B, 8C, and 8D are plan views of an array of modules for playing an acoustic sound and a touch sensation according to an embodiment of the inventive concept.

FIG. 8A is a plan view of an array of a module for playing an acoustic sound and a touch sensation, which includes unit cells. Referring to FIG. 8A, four diamond-shaped unit cells 13 may be arranged adjacent to each other to provide a diamond-shaped array. A description on the diamond-shaped unit cells 13 is substantially the same as the features described with reference to FIG. 7A.

Figure 8B:
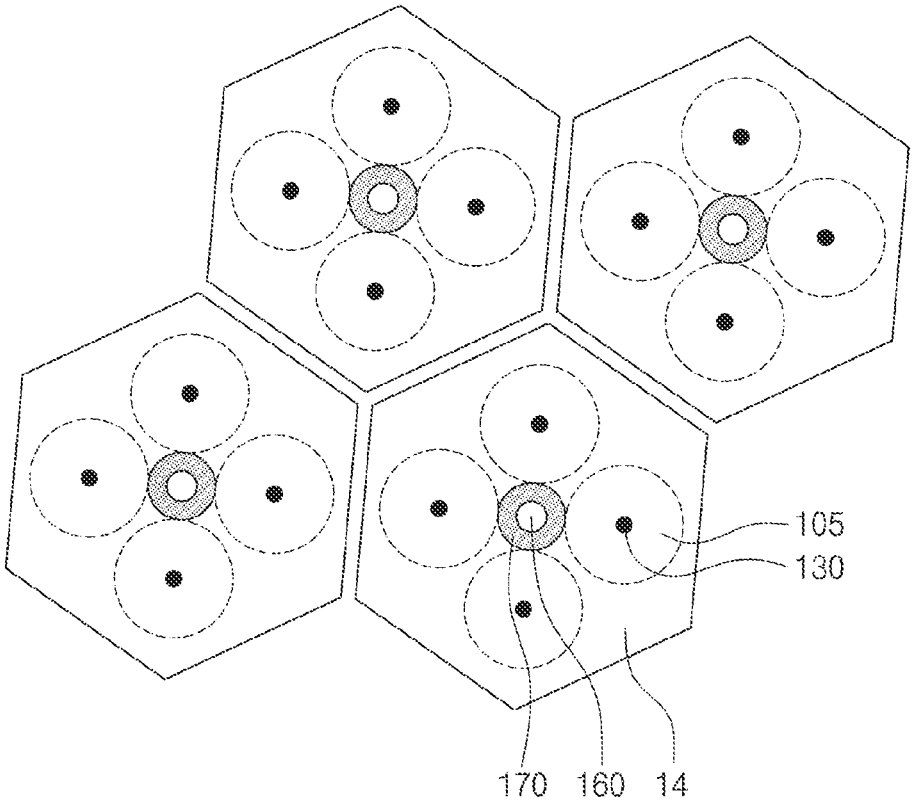

FIG. 8B is a plan view of an array of a module for playing an acoustic sound and a touch sensation, which includes unit cells. Referring to FIG. 8B, four hexagonal unit cells 14 may be arranged adjacent to each other to provide an array. A description on the hexagonal unit cells 14 is substantially the same as features described with reference to FIG. 7B.

Figure 8C:
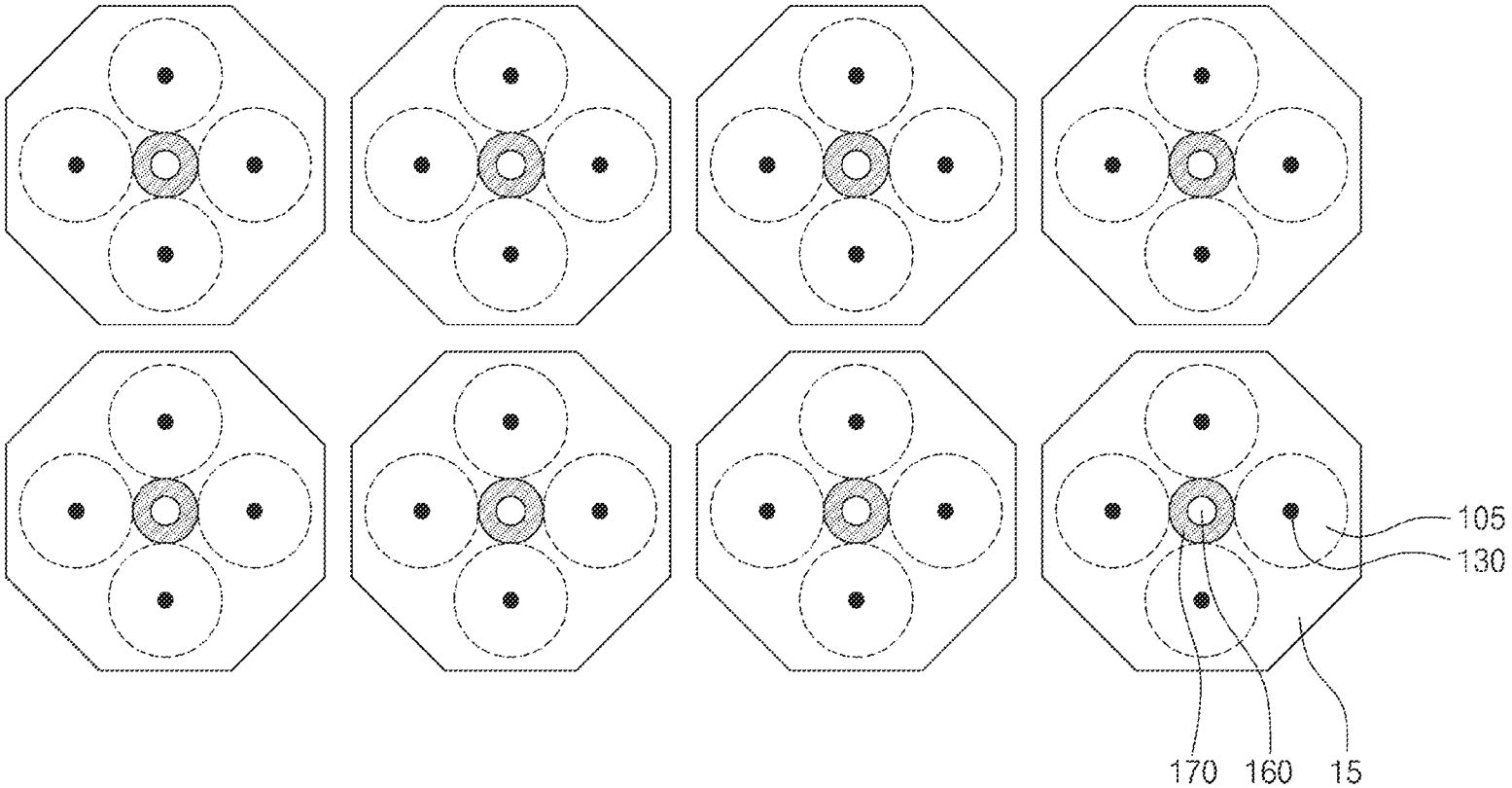

FIG. 8C is a plan view of an array of a module for playing an acoustic sound and a touch sensation, which includes unit cells. Referring to FIG. 8C, eight octagonal unit cells 15 may be arranged adjacent to each other to provide an array. A description on the octagonal unit cells 15 is substantially the same as features described with reference to FIG. 7C.

Figure 8D:
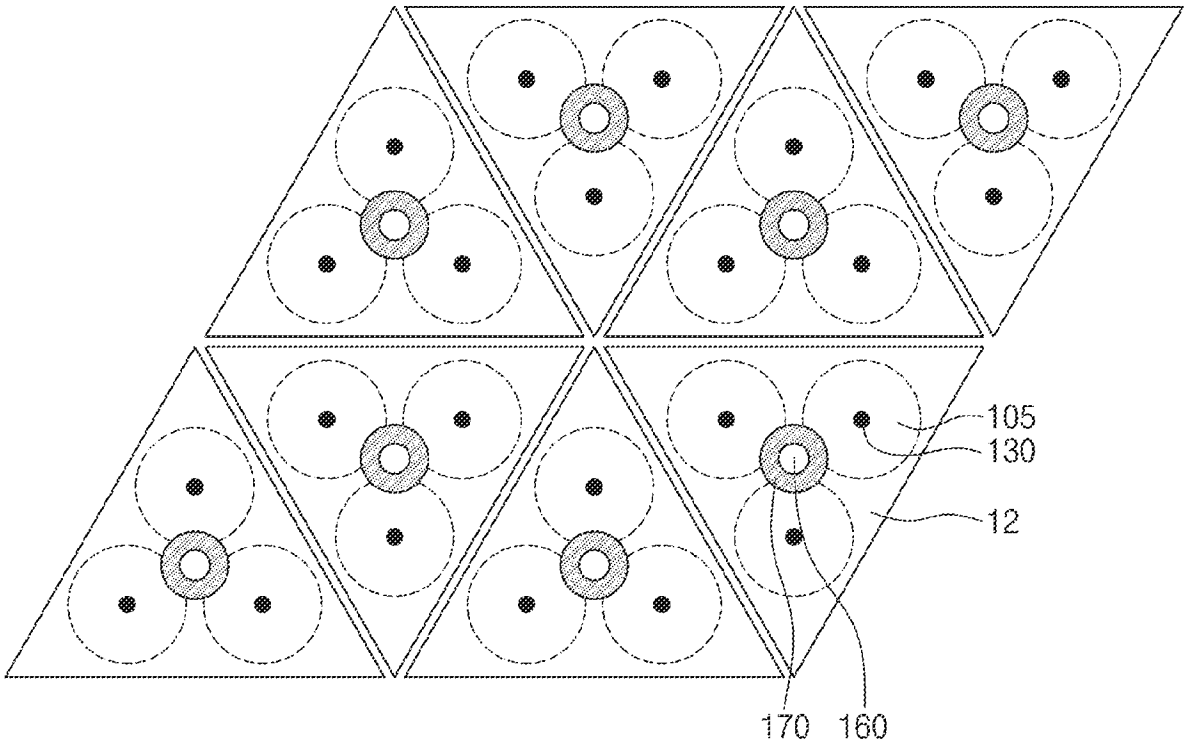

FIG. 8D is a plan view of an array of a module for playing an acoustic sound and a touch sensation, which includes unit cells. Referring to FIG. 8D, eight triangular unit cells 12 may be arranged adjacent to each other to provide an array. The triangular unit cells 12 may be alternately reversed so as to be arranged closest to each other. A description on the triangular unit cells 12 is substantially the same as features described with reference to FIG. 6.

As the array is constituted by arranging the variously shaped unit cells of the module for playing an acoustic sound and a touch sensation, a sound and a touch sensation response, which are transmitted to the user at a surface of a display, a touch sensation pad, and a touch pad, may be maximized to obtain a high output in comparison with a small area. As the frequency or amplitude of the acoustic wave is modulated through a plurality of speakers that are consecutively arranged, a frequency of a touch sensation vibration may be adjusted, or a pressure may be amplified to generate various touch sensation vibrations. Also, the array of the module for playing an acoustic sound and a touch sensation according to an embodiment of the inventive concept may specify a position at which a sound is emitted and a position at which a touch sensation response is generated to cause various touch sensation responses through signal adjustment.

According to the embodiment of the inventive concept, the acoustic sound and the touch sensation vibration may be simultaneously generated by the combination of the sound emitted from the speaker to the outside and the vibration of the actuator by transmitting the acoustic pressure emitted to the rear surface of the speaker to the touch sensation actuator. Here, as the frequency or the amplitude of the acoustic wave is modulated through the plurality of speakers, the frequency of the touch sensation vibration may be adjusted, or the pressure may be amplified to realize the various touch sensation vibrations. Also, since additional signal separation device is not required, the device may be driven through the simple circuit to have the high efficiency in comparison with the area thereof, and since the acoustic pressure emitted to the rear surface of the speaker is used, the device may be driven with the lower power to reduce the power consumption.

Although the embodiments of the present invention have been described, it is understood that the present invention should not be limited to these embodiments but various changes and modifications can be made by one ordinary skilled in the art within the spirit and scope of the present invention as hereinafter claimed. Therefore, the embodiments described above include exemplary in all respects and not restrictive, but it should be understood.

What is claimed is:

1. A device for playing an acoustic sound and a touch sensation, the device comprising:
- a lower frame;
- an upper frame disposed on the lower frame;
- two speakers spaced apart from each other in the upper frame;
- two speaker holes each disposed at an uppermost portion of the upper frame to emit a sound to the outside;
- a plurality of movement passages each extending from a lower portion of each of the speakers along the inside of the lower frame between the speakers;
- a pressure collecting part disposed between the speakers; and
- an actuator connected to the pressure collecting part,
- wherein an acoustic wave emitted to a lower portion of each of the speakers is transmitted to the pressure collecting part through the movement passages.

2. The device of claim 1,
- wherein the speakers generate a sound, and
- the actuator generates a touch sensation to a user through a vibration transmitted from the pressure collecting part,
- wherein the sound and the touch sensation are generated at the same time.

3. The device of claim 1, further comprising two chambers that are empty spaces in the upper frame,
- wherein the speakers are disposed in the chambers, respectively.

4. The device of claim 3, wherein the speaker comprises a vibration plate and a membrane,
- wherein the membrane emits an acoustic wave in upward and downward directions, and
- wherein the vibration plate vibrates air in the chamber by the acoustic wave emitted in the upward direction.

5. The device of claim 1,
- wherein each of the speakers independently generates an acoustic wave having a different frequency or a different amplitude.

6. The device of claim 1,
- wherein the speaker holes amplify an acoustic wave emitted to an upper portion of the speaker and generate a sound to the outside.

7. The device of claim 1, further comprising a fixing part configured to fix the actuator,
- wherein the fixing part comprises a flexible material.

8. The device of claim 1, further comprising one pressure collecting part and one actuator,
- wherein each of the pressure collecting parts and actuators is connected to each of the movement passages.

9. The device of claim 1, wherein the movement passages comprise a gas, a liquid, or a gel therein.

10. A device for playing an acoustic sound and a touch sensation, the device comprising a plurality of unit cells,
- wherein each of the unit cells comprises:
  - two speakers;
  - two speaker holes disposed on the speakers, respectively, to emit a sound to the outside; and an actuator disposed between the two speakers to generate a touch sensation vibration, a plurality of movement passages each extending from the rear surface of each of the speakers to a rear surface of the actuator, and a pressure collecting part disposed between the movement passages and the rear surface of the actuator, wherein the speakers generate a sound to the outside by emitting an acoustic wave to a front surface of each of the speakers, and wherein an acoustic wave emitted to a rear surface of each of the speakers is transmitted to the actuator to generate a vibration, wherein the movement passages comprise a gas, a liquid, or a gel therein, and wherein the pressure collecting part concentrates an acoustic wave transmitted from the movement passages and transmits the concentrated acoustic wave to the actuator.

11. The device of claim 10, further comprising one speaker, one speaker hole, and a fixing part configured to fix the actuator, wherein the actuator and the fixing part are disposed at a center of three speakers.

12. The device of claim 10, further comprising two speakers, two speaker holes, and a fixing part configured to fix the actuator, wherein the actuator and the fixing part are disposed at a center of four speakers.

13. The device of claim 10, further comprising a fixing part disposed between the two speakers to fix the actuator.

14. The device of claim 10, wherein the unit cells comprise any one of a triangular shape, a rectangular shape, a diamond shape, a hexagonal shape, or an octagonal shape, and wherein the unit cells are disposed adjacent to each other.

* * * * *